United States Patent [19]

Skinner

[11] 4,426,882

[45] Jan. 24, 1984

[54] APPARATUS AND METHOD FOR SENSING DOWNHOLE CONDITIONS

[75] Inventor: Neal G. Skinner, Duncan, Okla.

[73] Assignee: Halliburton Company, Duncan, Okla.

[21] Appl. No.: 326,540

[22] Filed: Dec. 2, 1981

[51] Int. Cl.[3] ..... E21B 47/06

[52] U.S. Cl. ..... 73/155; 73/152; 73/151

[58] Field of Search ..... 73/152, 155, 151

[56] References Cited

U.S. PATENT DOCUMENTS

| | | | |
|---|---|---|---|
| 2,702,474 | 2/1955 | Johnston | 73/152 |
| 2,982,130 | 5/1961 | McMahan | 73/155 |
| 3,062,052 | 11/1962 | Kolb | 73/152 |
| 3,308,882 | 3/1967 | Lebourg | 73/155 |
| 3,323,361 | 6/1967 | Lebourg | 73/155 |
| 3,448,611 | 6/1969 | Lebourg | 73/151 |
| 4,316,386 | 2/1982 | Kerekes | 73/151 |

*Primary Examiner*—Howard A. Birmiel
*Attorney, Agent, or Firm*—Joseph A. Walkowski; Thomas R. Weaver

[57] ABSTRACT

A downhole condition sensing apparatus and method which provide a surface readout of a sensed condition includes and utilizes a downhole tool having a housing defined by a control section, a gauge section, an accumulator section, and a tester section. The control section includes electronic circuit elements for controlling the operation of the tool and for conveying electrical signals to the surface. The gauge section includes a pressure sensing element for sensing pressures in a well in which the tool is located and for converting the sensed pressures into corresponding electrical signals. The accumulator section includes a pressurizing fluid chamber, a driving fluid chamber, and an accumulator chamber. A pressurized driving fluid contained in the driving fluid chamber for controlling a valve located in the tester section is switchably communicated to the tester section by means of a solenoid valve located in the accumulator section. The valve of the tester section is moved between an open position and a closed position by the driving fluid from the driving fluid chamber acting on one of two surfaces of the valve. When the valve is open, the well is allowed to flow through openings formed in the tester section; and when the valve is closed, fluid is prevented from flowing between the openings of the tester section.

41 Claims, 16 Drawing Figures

APPARATUS AND METHOD FOR SENSING DOWNHOLE CONDITIONS

This invention relates generally to apparatus and methods for sensing downhole conditions in a well and for providing the information to the surface as the conditions are sensed. The invention relates more particularly, but not by way of limitation, to a wireline tool and method for providing real-time surface readouts of drill stem test data.

In drilling and operating a well it is necessary to monitor downhole conditions, such as temperature and pressure, to obtain information which is helpful in evaluating the nature of the well, such as whether the well is likely to produce. One particular condition which is preferably monitored is downhole pressure measured over periods of time during which the well is alternately allowed to flow and prevented from flowing. This condition is determined by means of a drill stem test which can be conducted utilizing the Bourdon tube technique known in the art. With this technique a chart having a pressure versus time graph scribed thereon can be obtained.

A shortcoming of the Bourdon tube technique is that no real-time or substantially instantaneous readout of the sensed pressure is available at the surface while the pressure is being detected. A real-time readout is needed to permit a person at the well site to quickly know what is occurring downhole during the test periods. The shortcoming exists because to perform a drill stem test using the Bourdon tube technique, a tool containing an unscribed chart and a Bourdon tube instrument are lowered into the well, the well is alternately allowed to flow and prevented from flowing to cause the Bourdon tube instrument to scribe a pressure versus time graph on the chart, and then the tool is withdrawn from the well and the chart analyzed at some relatively considerable time subsequent to the actual time during which the pressures were detected and the chart was created.

The present invention is directed to an apparatus and method which overcome this shortcoming of the Bourdon tube technique for detecting downhole pressures. In particular, the present invention provides a tool which senses downhole pressure and provides at the surface a real-time or substantially instantaneous readout of the sensed pressure concomitantly with the detection of the pressure. Other downhole conditions can also be detected and communicated to the surface concomitantly with their detection.

The present invention not only provides a real-time surface readout of the sensed pressure (and/or other sensed conditions), but it also electro-hydraulically controls the well to achieve the flowing and non-flowing periods necessary to conduct a drill stem test. This feature is advantageous because it permits the flow of the well to be controlled through the operation of the tool itself, rather than through some external device such as a conventional tester valve whose use is known in the art. Indeed, the present invention is contemplated to be usable without a conventional tester valve placed in a downhole tubing in which the tool is located. By obviating the necessity of using a conventional tester valve in the tubing, the length of the tool string containing the present invention can be reduced.

The present invention further closes in the well if electrical control signals used for controlling the present invention are lost thereby providing for fail safe operation.

The present invention is constructed so that it can be easily maintained and so that it can be located in a plurality of positions in the tubing whereby areas in which debris accumulates can be avoided.

Broadly, the present invention includes a surface unit and a well unit. The surface unit is located outside of the well and includes means for indicating the pressure sensed by a pressure sensing means located in the well unit. The surface unit also includes control means for providing control signals to the well unit. These means of the surface unit are constructed and used as known in the art.

The well unit broadly includes an elongated housing having an interior surface defining a central void region extending through the housing between a first end and a second end thereof. The housing also has an exterior surface extending between the first and second ends. A communicating surface extends through the housing between the interior and exterior surfaces to define an opening through which a fluid in the central void region can be communicated to the exterior surface of the housing.

The well unit also broadly includes valve means disposed in the housing for permitting the fluid to flow from the central void region through the opening to the exterior surface of the housing or for preventing the fluid from flowing from the central void region through the opening to the exterior surface of the housing. To operate the valve means, the well unit also includes valve drive means. The valve drive means includes fail safe means for positioning the valve means to prevent the fluid from flowing through the opening to the exterior surface of the housing when the control signals sent from the surface unit are not received by the valve drive means.

The well unit also broadly includes pressure sensing means disposed in the housing for sensing pressure in the well when the valve means is either permitting or preventing fluid flow. The well unit also includes temperature sensing means or other suitable condition sensing means.

More particularly, the housing comprises a tester section having the opening defined therein and having the valve means disposed therein, an accumulator section connected to the tester section, a gauge section connected to the accumulator section, and a control section connected to the gauge section. The accumulator section has the valve drive means disposed therein; the gauge section has the pressure sensing means disposed therein; and the control section has the electronic means disposed therein. The accumulator section also has chambers and channels which can be suitably communicated to transfer a driving fluid to the tester section to actuate the valve means. Associated with the tester section is a locking element for releasably retaining the well unit in the well at a desired location.

So that electrical signals can be transferred between the control section and the gauge section, the well unit includes a first electrical connector means associated with the gauge section and a second electrical connector means associated with the control section. These electrical connector means are suitably constructed so that they may be easily replaced.

From the foregoing it is a general object of the present invention to provide a novel and improved apparatus and method for sensing downhole conditions in a well and for providing the information to the surface as the conditions are sensed. Other and further objects, features and advantages of the present invention will be readily apparent to those skilled in the art when the following description of the preferred embodiment is read in conjunction with the accompanying drawings.

FIGS. 1A-1H form a schematic partial sectional elevational view of the well unit of the present invention.

Figure 9:
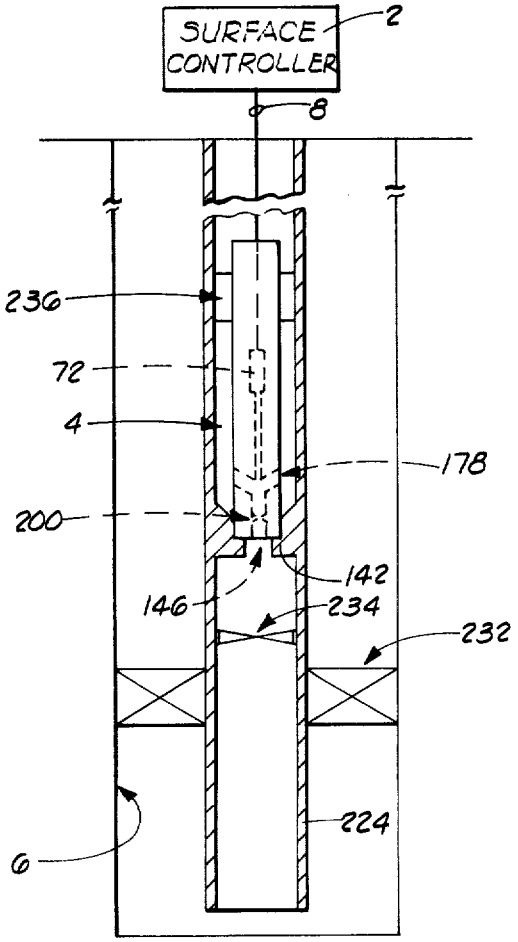
FIG. 9 is a schematic illustration of the present invention disposed in a well.

With reference to the drawings the preferred embodiment of the present invention will be described. The preferred embodiment includes a surface controller unit 2 and a well unit 4 as schematically illustrated in FIG. 9. The well unit 4 comprises a wireline tool for being lowered into a well 6 to receive and monitor the well pressure and other well conditions, such as temperature.

The surface unit 2 is located outside the well 6. The surface unit 2 includes indication or readout means which indicates the sensed pressure in response to electrical signals corresponding to the pressure sensed by the well unit 4. The readout means also displays any other conditions which are sensed by the well unit 4. The surface unit 2 further includes control means for providing electrical control signals to operate the well unit 4. The surface unit 2 is constructed of elements and in a manner as is known in the art. The surface controller unit 2 is connected to the well unit 4 by means of a wireline 8 as illustrated in FIG. 9. The electrical signals transferred between the surface unit 2 and the well unit 4 are conducted over the wireline 8.

The preferred embodiment of the well unit 4 is illustrated in FIGS. 1-8. FIGS. 1A-1H show that the preferred embodiment well unit 4 includes a housing having four sections. These four sections include a control section 10 illustrated in FIGS. 1A-1B, a gauge section 12 illustrated in FIGS. 1B-1C, an accumulator section 14 illustrated in FIGS. 1C-1F, and a tester section 16 illustrated in FIGS. 1F-1H.

Figure 1A:
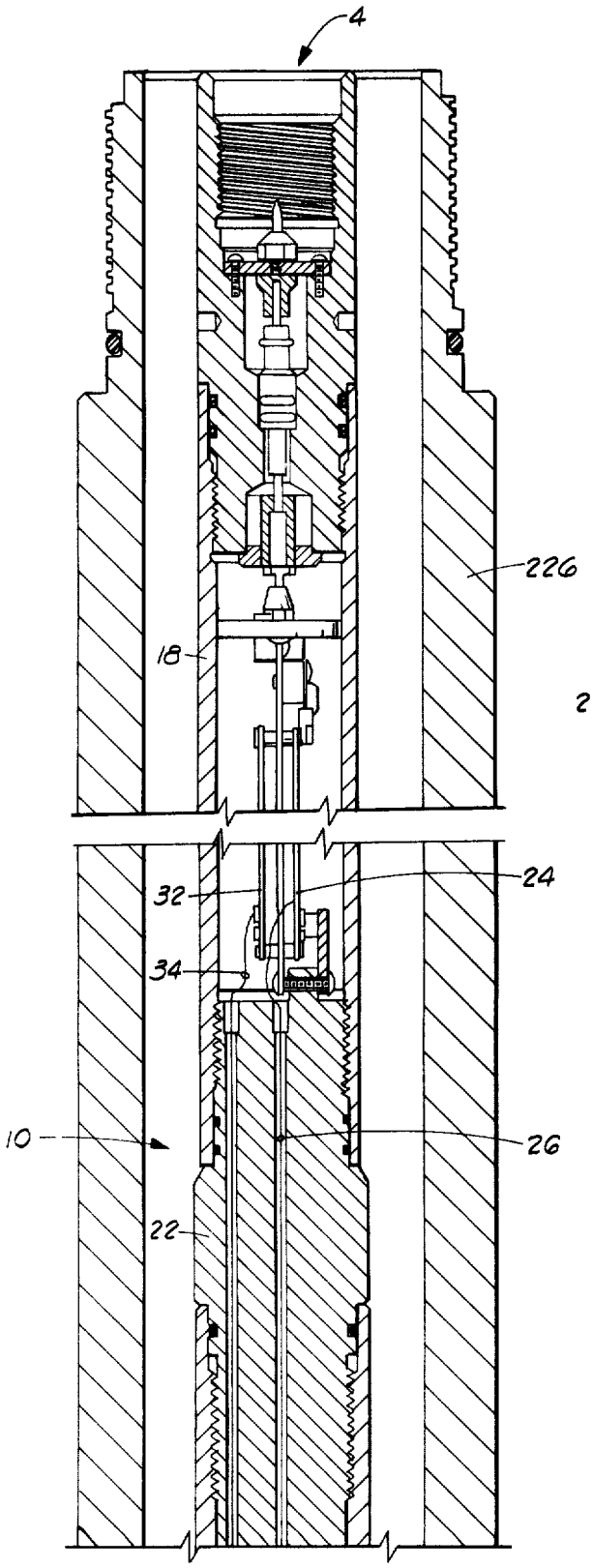
Figure 1B:
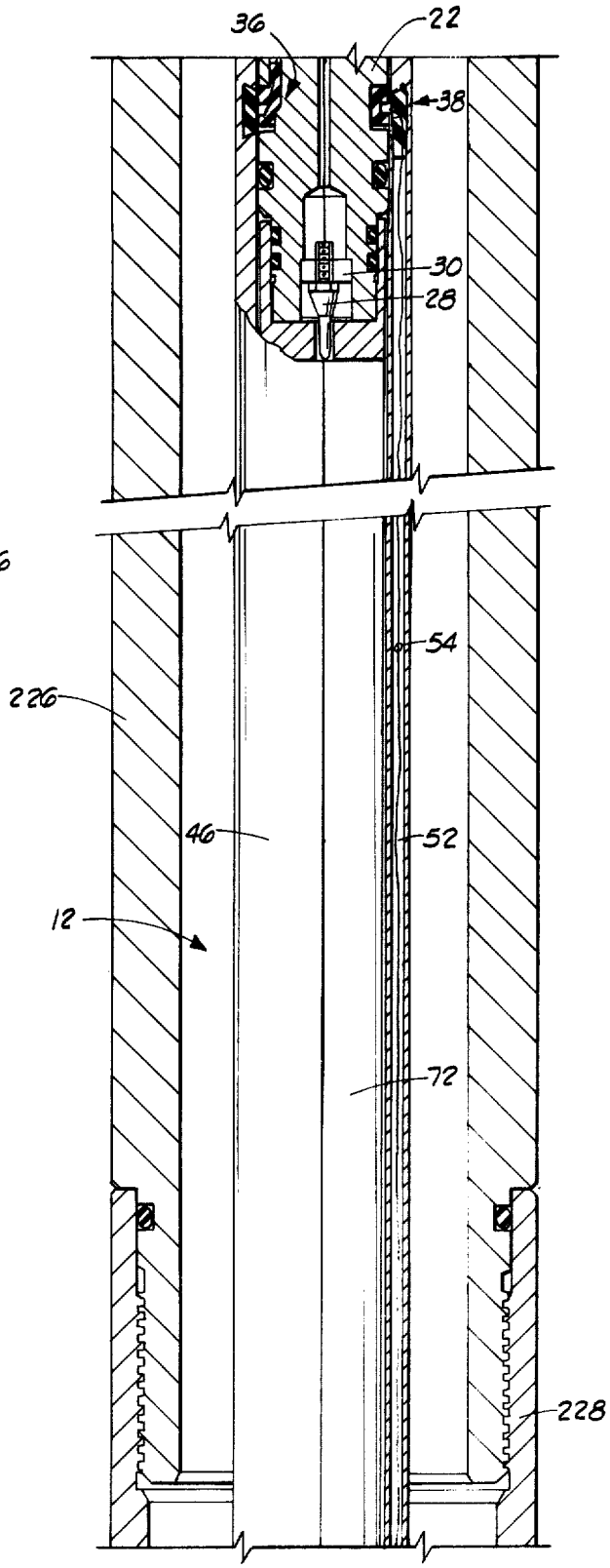

The control section 10 illustrated in FIGS. 1A-1B includes a control housing or structural means comprising in the preferred embodiment an upper control housing 18 and a coupling element 22 threadedly connected to the upper control housing 18 and the gauge section 12.

The upper control housing 18 has a hollow interior region in which are disposed first electronic means and second electronic means. The first electronic means contains electrical circuits for communicating a signal corresponding to the magnitude of the sensed pressure or other conditions to a location spaced from the well unit 4. Particularly, this signal is communicated to the surface unit 2 for actuating the readout means. The electronic circuit elements of the first electronic means multiplex to the surface unit 2 the signals representing the sensed conditions.

The first electronic means is illustrated in FIG. 1A by means of a first printed circuit board 24 appropriately mounted in the hollow interior region of the upper control housing 18. The first printed circuit board 24 has suitable electronic circuit elements mounted thereon for receiving electrical signals from the gauge section 12 over a suitable electrical conductor 26 passing through a conductor channel disposed through the coupling element 22. The electrical conductor 26 terminates at the end of the coupling element 22 at a banana plug 28 which is retained within the coupling element 22 by means of an insulator 30. The banana plug 28 provides an electrical connection with a mating element (not shown) disposed in the gauge section 12. The preferred embodiment electronic circuits of the first electronic means also include suitable sensor means for sensing temperature and for communicating to a location spaced from the well unit a signal representing the temperature.

The second electronic means includes electrical circuit elements for providing electrical control signals for controlling subsequently described elements in the accumulator section 14. In FIG. 1A the second electronic means is illustrated as a second printed circuit board 32 appropriately mounted in the interior hollow region of the upper control housing 18. The electrical circuits of the second electronic means include power supply means and switching logic means for controlling subsequently described elements in the accumulator section 14. This control is achieved by means of electrical signals transferred over electrical conductor means, such as a wire 34, passing through a second electrical conductor channel disposed in the coupling 22. The wire 34 terminates near the outer periphery of the coupling 22 at an electrical connector means 36.

The electrical connector means 36 electrically contacts another electrical connector means 38 associated with the gauge section 12. This electrical contact is made so that an electrical signal can be conducted through the connector means 36 and 38 for transmission to a subsequently described element in the accumulator section 14.

Figure 2:
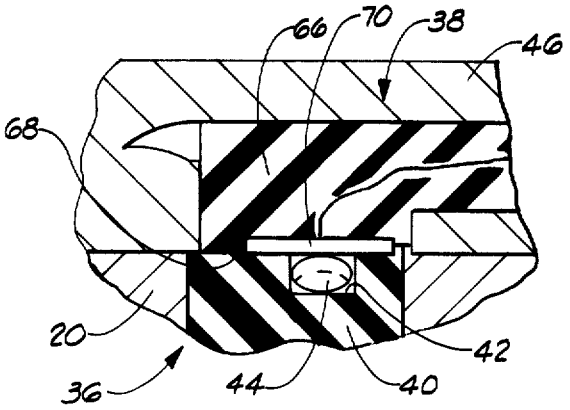
FIG. 2 is an enlarged partial view of the first and second electrical connector means shown in FIG. 1B.

As shown in FIG. 2 the electrical connector means 36 of the prefferred embodiment includes a resilient member 40 releasably disposed in a groove located on the outer periphery of the connector 22. The resilient member 40 has an outer surface 42 facing the gauge section 12. An electrical conductor means 44 is disposed along the outer surface 42. The resilient member 40 of the preferred embodiment is a silicon rubber exterior ring connector releasably secured around the connector 22 by means of a spring connector forming the preferred embodiment of the electrical conductor means 44. This construction of the electrical connector means 36 permits it to be easily interchanged in a manner substantially like an O-ring as is known in the art thereby permitting easy replacement for maintenance or other purposes.

Figure 1C:
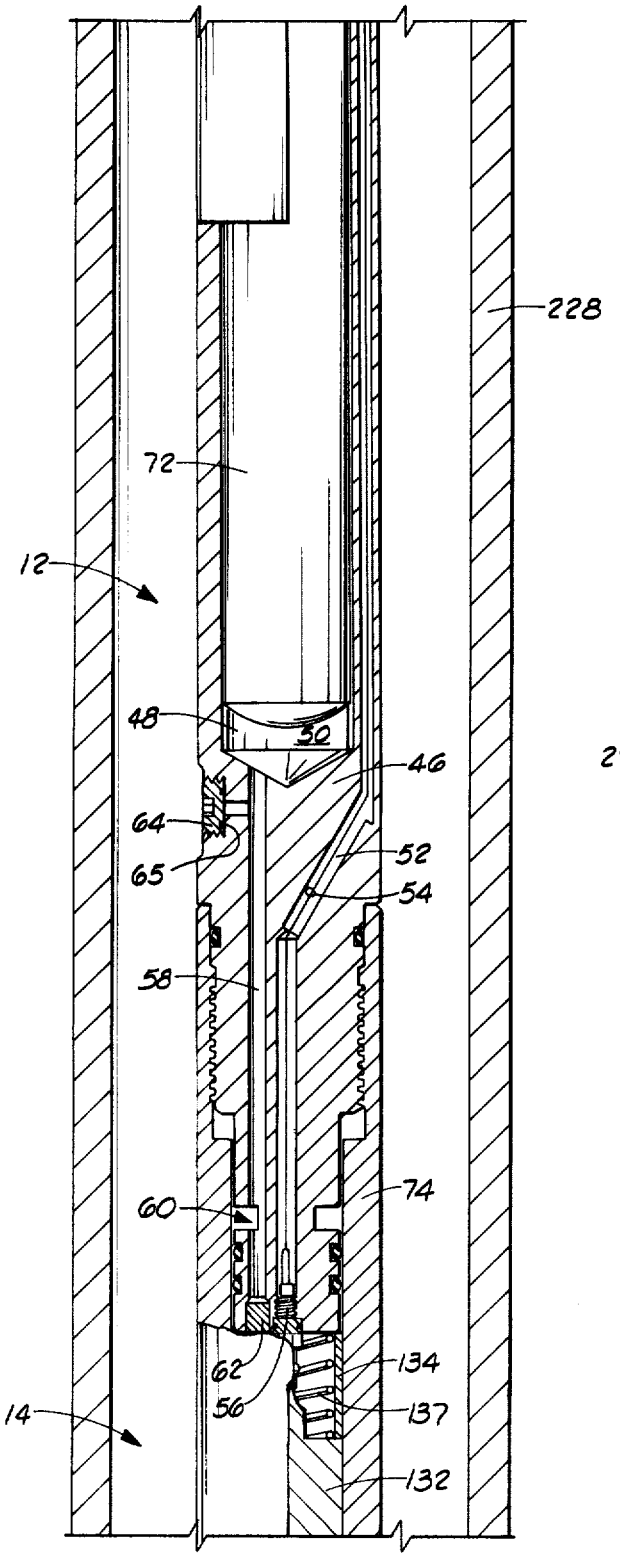

As shown in FIGS. 1B-1C the gauge section 12 includes a gauge housing or body comprising a wall 46 having an interior surface 48 defining a cavity 50. Disposed in the wall 46 is an electrical conductor channel 52 through which an electrical conductor 54 extends from the electrical connector means 38 to another electrical connector means 56 shown in FIG. 1C. The connector means 56 of the preferred embodiment is a connector sold under the trademark Kemlon.

The wall 46 forms the gauge housing through which a gauge test pressure channel 58 extends from the cavity 50 to a groove 60 located along the outer periphery of the gauge housing. The channel 58 also extends to a port which is closed by a plug 62 such as one sold under the trademark Lee Plug. A plug 64 provides a closure to another port intersecting the channel 58 as also shown in FIG. 1C. The closure provided by the plug 64 is made fluid-tight by means of an O-ring 65.

As shown in FIG. 2 the electrical connector means 38 associated with the gauge housing includes a resilient member 66 forming in the preferred embodiment an interior connector ring releasably disposed in an interior groove of the wall 46. The resilient member 66 has an inner surface 68 which faces the structural means of the control section 10 when the coupling 22 and the gauge body are connected. Disposed along the inner surface 68 of the resilient member 66 is an electrical conductor means 70 which is in contact with the electrical conductor means 44 of the electrical connector means 36 when the coupling 22 and the gauge body are connected. As with the electrical connector means 36, the electrical connector means 38 of the preferred embodiment has a silicon rubber member as the resilient member 66 which is retained in the groove of the wall 46 so that it can be readily interchanged in a manner similar to an O-ring. The electrical connector means 38 receives the electrical signal transmitted by the electronic means on the printed circuit board 32 through the electrical connector means 36 for conducting the electrical signal to the accumulator section 14 over the conductor 54.

Referring to FIGS. 1B and 1C, disposed in the cavity 50 is a pressure sensing means 72 for sensing pressure in the well. The pressure to be sensed is received in the cavity 50 through the channel 58. The pressure is received in the cavity 50 both when the well unit is permitting fluid flow and when the well unit is preventing fluid flow as will become apparent after the subsequent description of the accumulator and tester sections. In the preferred embodiment the pressure sensing means 72 is a Hewlett-Packard quartz pressure gauge known in the art. It is contemplated that the pressure sensing means can be provided by a combination device which senses both pressure and temperature thereby obviating the need for having a temperature sensing means located in the control section 10 as described hereinabove.

The preferred embodiment of the accumulator section 14 is illustrated in FIGS. 1C–1F. The accumulator section 14 includes an accumulator housing or body including a wall 74 having an interior surface 76 defining side boundaries of a cavity which includes three chambers. The three chambers are a pressurizing fluid chamber 78 for receiving a pressurizing fluid, a driving fluid chamber 80 for receiving a driving fluid, and an accumulator chamber 82. In the preferred embodiment the pressurizing fluid chamber 78 receives nitrogen and is thus labeled "NITROGEN CHAMBER" in FIGS. 1E–1F, and the driving fluid chamber 80 receives hydraulic oil and is thus labeled "HYDRAULIC OIL CHAMBER" in FIG. 1E. The accumulator chamber of the preferred embodiment provides a low pressure reservoir or accumulator for hydraulic oil.

Figure 7:
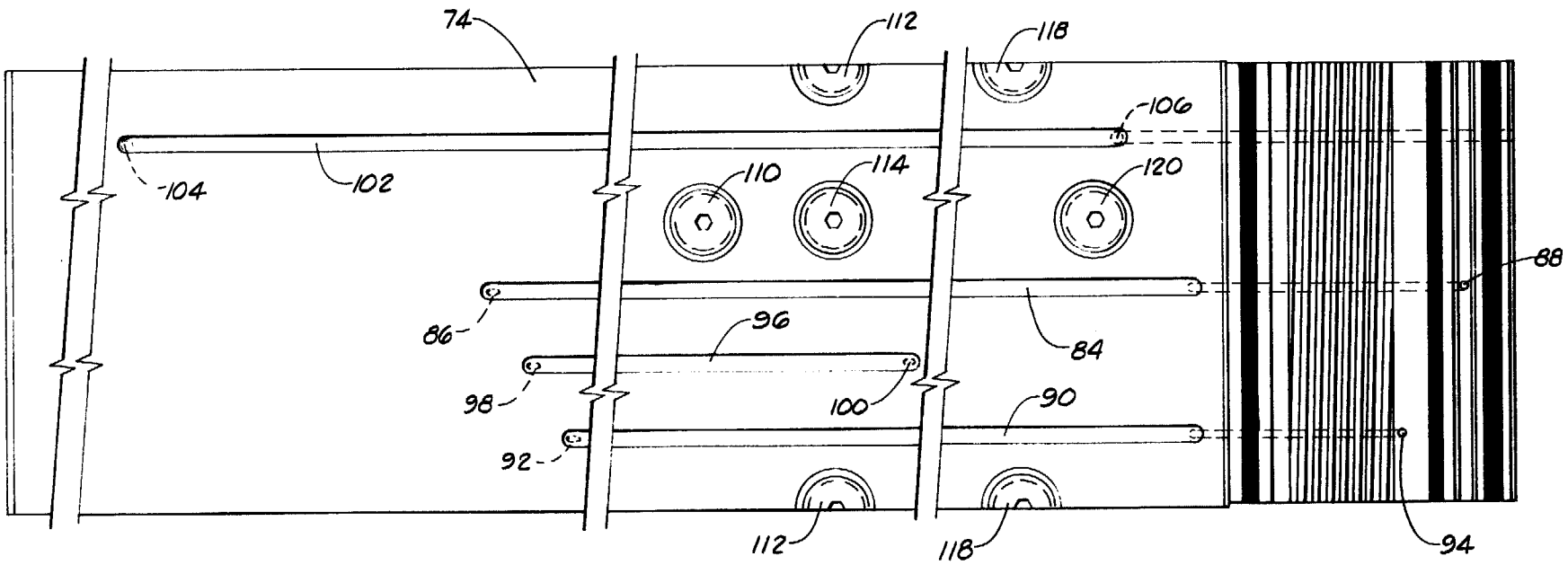
FIG. 7 is a planar representation of the accumulator section body showing four channels disposed therein.

Defined in the wall 74 of the accumulator section 14 are four channels as illustrated in FIG. 7. One channel is a first accumulator channel 84 defined in the wall 74 for switchably communicating the driving fluid either from the driving fluid chamber 80 to the tester section 16 or from the tester section 16 to the accumulator chamber 82. The first accumulator channel 84 has a first end which opens through the interior surface of the wall 74 via a port 86 spaced between the accumulator chamber 82 and a first end of the accumulator section 14. The first accumulator channel 84 has a second end which opens through the exterior surface of the wall 74 by means of a port 88 located between a second end of the accumulator section 14 and the pressurizing fluid chamber 78.

Another one of the channels is a second accumulator channel 90 defined in the wall 74 for switchably communicating the driving fluid from the tester section 16 to the accumulator chamber 82 when the first accumulator channel 84 communicates the driving fluid from the driving fluid chamber 80 to the tester section 16 or communicating the driving fluid from the driving fluid chamber 80 to the tester section 16 when the first accumulator channel 84 communicates the driving fluid from the tester section 16 to the accumulator chamber 82. The second accumulator channel 90 opens at a first end through the interior surface of the wall 74 at a port 92 spaced between the accumulator chamber 82 and the first end of the accumulator section 14. In the preferred embodiment the port 92 is spaced farther from the first end than is the port 86. The second accumulator channel 90 opens through the exterior surface of the wall 74 at another port 94 spaced between the second end of the accumulator section 14 and the pressurizing fluid chamber 78. The port 94 is spaced farther from the second end of the accumulator section 14 than is the port 88.

A third one of the channels is a driving fluid channel 96 defined in the wall 74 for communicating driving fluid from the driving fluid chamber 80 to either the first accumulator channel 84 or the second accumulator channel 90. In the preferred embodiment the driving fluid is under relatively high pressure and thus the channel 96 is also denominated a high pressure channel. The channel 96 opens at a first end thereof through the interior surface of the wall 74 at a port 98 spaced from and in between the ports 86 and 92. The channel 96 opens at a second end thereof through the interior surface of the wall 74 into the driving fluid chamber 80 at another port 100.

Another channel is a test pressure channel 102 which has a first end opening through the interior surface of the wall 74 at a port 104 which is located in communication with the groove 60 of the gauge section 12. The test pressure channel 102 also opens through the interior surface of the wall 74 at a port 106 spaced from the second end of the accumulator section 14 a distance greater than either of the distances the port 88 or the port 94 are spaced from the second end. The port 106 opens into a centrally positioned cavity 108 extending into the wall 74 from the second end of the accumulator section 14. The test pressure channel 102 is defined in the wall 74 for communicating well pressure from the tester section 16 to the gauge section 12.

Each of the four channels is constructed in the preferred embodiment by machining or otherwise forming in the wall 74 initial grooves extending inwardly from the exterior surface of the wall 74. Countersunk grooves are formed above the initial grooves, and closure wall elements are secured in the countersunk grooves by suitable means, such as by welding. This construction is illustrated in FIGS. 3–6, and the four channels are schematically illustrated in FIG. 7 wherein the solid lines defining the channels represent the countersunk closure wall elements.

Figure 3:
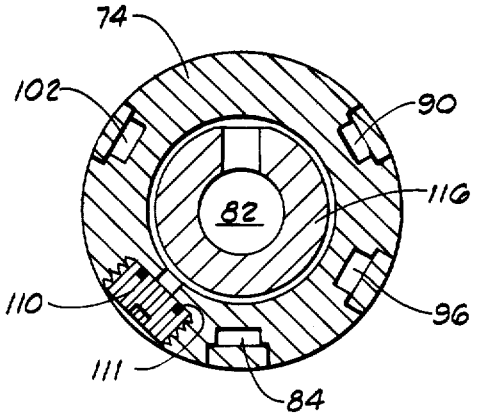
FIG. 3 is a sectional view taken along line 3—3 shown in FIG. 1E.
Figure 4:
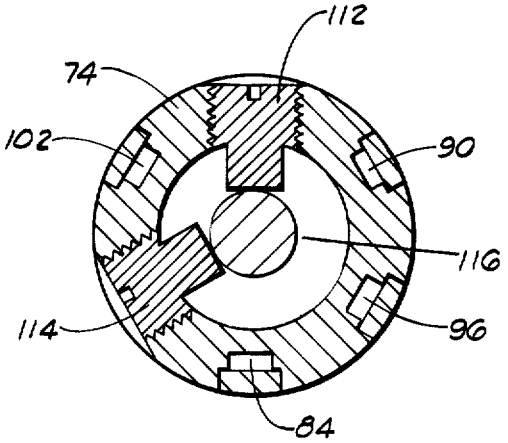
FIG. 4 is a sectional view taken along line 4—4 shown in FIG. 1E.
Figure 5:
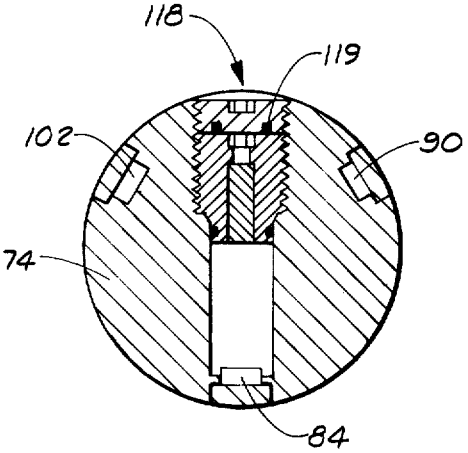
FIG. 5 is a sectional view taken along line 5—5 shown in FIG. 1F.
Figure 6:
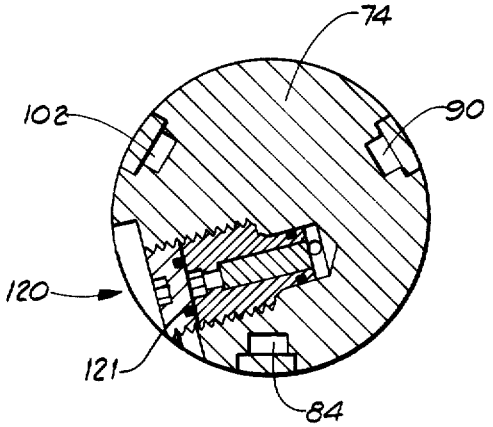
FIG. 6 is a sectional view taken along line 6—6 shown in FIG. 1F.

As illustrated in FIGS. 3–6, the first accumulator channel 84, the second accumulator channel 90 and the test pressure channel 102 are spaced from each other by angles of approximately 120° and are disposed near the outer periphery of the substantially cylindrical accumulator body. The driving fluid channel 96 which appears in FIGS. 3 and 4 is spaced between the first and second accumulator channels by angles of approximately 60°. To permit fluids to be introduced into the channels or drained from the channels, suitable ports and closure plugs are provided as shown in FIGS. 3, 5 and 6. A retaining means is illustrated in FIG. 4.

FIG. 3 discloses a plug 110 which closes a drainage port extending from the accumulator chamber 82. The plug 110 has an O-ring 111 associated therewith for providing a fluid-tight seal.

FIG. 4 discloses a retaining pin 112 and a retaining pin 114 which are used to retain a separator element 116 in the cavity of the accumulator section 14. The separator element 116 defines the boundary between the accumulator chamber 82 and the driving fluid chamber 80. The separator element 116 provides a fluid tight boundary by means of the O-rings and back-up elements illustrated in FIGS. 1D–1E.

FIG. 5 illustrates a plug and check valve assembly 118 and an O-ring 119 used for closing a port extending from the exterior surface of the wall 74 to the first accumulator channel 84. It is through the plug of the assembly 118 and the associated port that the driving fluid, such as hydraulic oil, is introduced into the driving fluid chamber 80.

FIG. 6 discloses a plug and check valve assembly 120 and an O-ring 121 providing a closure to a port communicating the exterior surface of the wall 74 with the pressurizing fluid chamber 78. Through this port a pressurizing fluid, such as nitrogen, can be introduced into the pressurizing fluid chamber 78.

The accumulator section 14 also includes a valve drive means for moving a valve means located in the tester section 16. The valve drive means includes a floating accumulator piston 122 slidably disposed between the pressurizing fluid chamber 78 and the driving fluid chamber 80. In the preferred embodiment the accumulator piston 122 defines the boundary between these two chambers. This boundary is movable in response to pressure differentials between the fluids receivable by the pressurizing fluid chamber 78 and the driving fluid chamber 80. In the preferred embodiment the accumulator piston 122 includes a substantially cylindrical body having cavities 124 and 126 defined therein. The substantially cylindrical body is fluid-tightly disposed in the main cavity of the wall 74 by means of O-rings 128 and back-up elements 130.

Figure 1D:
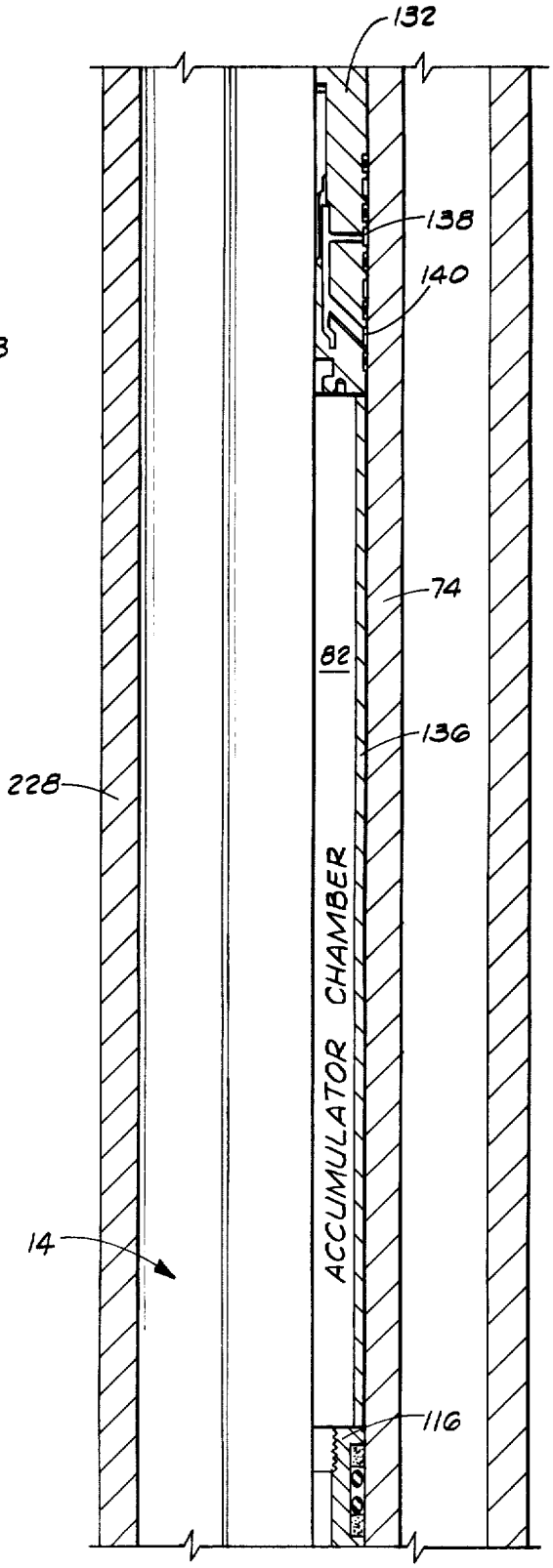
Figure 1E:
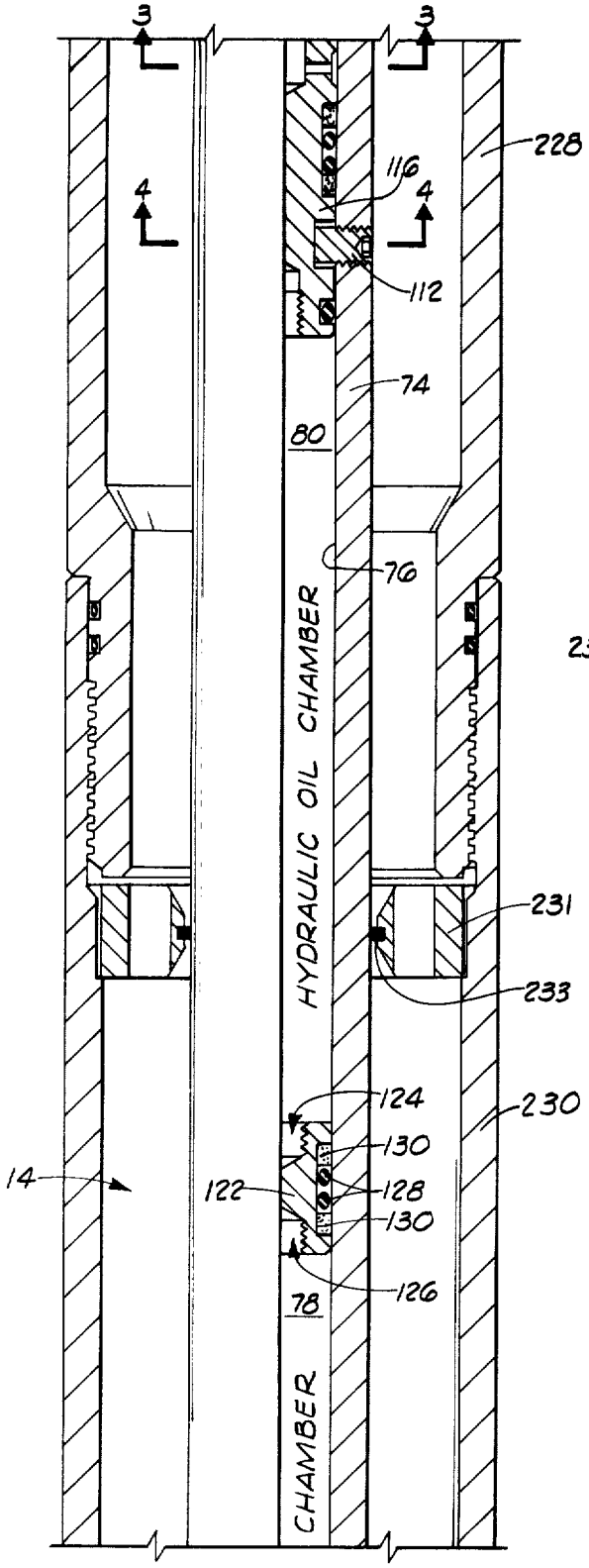

The valve drive means also includes an accumulator valve means for switchably connecting the driving fluid channel 96 with either the first accumulator channel 84 or the second accumulator channel 90. In the preferred embodiment the accumulator valve means includes a solenoid valve 132 of a suitable type. As shown in FIGS. 1C and 1D the solenoid valve 132 is maintained in its position within the accumulator section by means of a short spacer sleeve 134 and a long spacer sleeve 136. The short spacer sleeve 134 is retained by a spacer spring 137. A first end of the short spacer sleeve 134 abuts the second end of the gauge body when the gauge body and the accumulator housing are joined. A second end of the short spacer sleeve 134 abuts a first end of the solenoid valve 132. The long spacer sleeve 136 is positioned so that a first end thereof abuts a second end of the solenoid valve 132 and a second end thereof abuts the end of the separator element 116 which defines an end boundary of the accumulator chamber 82.

In the preferred embodiment the solenoid valve 132 is a four-way, two-position valve having channels 138 and 140 as shown in FIG. 1D. These channels are fluid-tightly sealed from each other by means of the O-rings and back-up elements illustrated in FIG. 1D. The channel 138 communicates at a first end with the port 86 of the first accumulator channel 84, and the channel 140 communicates at a first end with the port 92 of the second accumulator channel 90. Second ends of the channels 138 and 140 are switchably connected to either the accumulator chamber 82 or the port 98 of the driving fluid channel 96 by means of a poppet (not shown) disposed inside the solenoid valve 132 and positioned by the electromagnetic field of a solenoid coil associated with the solenoid valve. When the poppet is positioned one way, it connects the port 86 of the first accumulator channel 84 to the port 98 of the driving fluid channel 96 and at the same time connects the port 92 of the second accumulator channel with the accumulator chamber 82. When the poppet is positioned a second way, the port 86 is connected to the accumulator chamber 82, and the port 92 is connected to the port 98.

The solenoid valve 132 is preferably constructed so that when electrical power is off (i.e., no electromagnetic field is present) the valve 132 channels the pressurized driving fluid to the tester section 16 so that the valve means disposed therein is closed. This provides a fail safe feature to the present invention in the event the control signals from the surface unit 2 are not received by the controller electronic means of the control section 10. Such signal loss may occur if the wireline 8 is cut or otherwise damaged or if electrical power at the surface is lost.

Figure 1F:
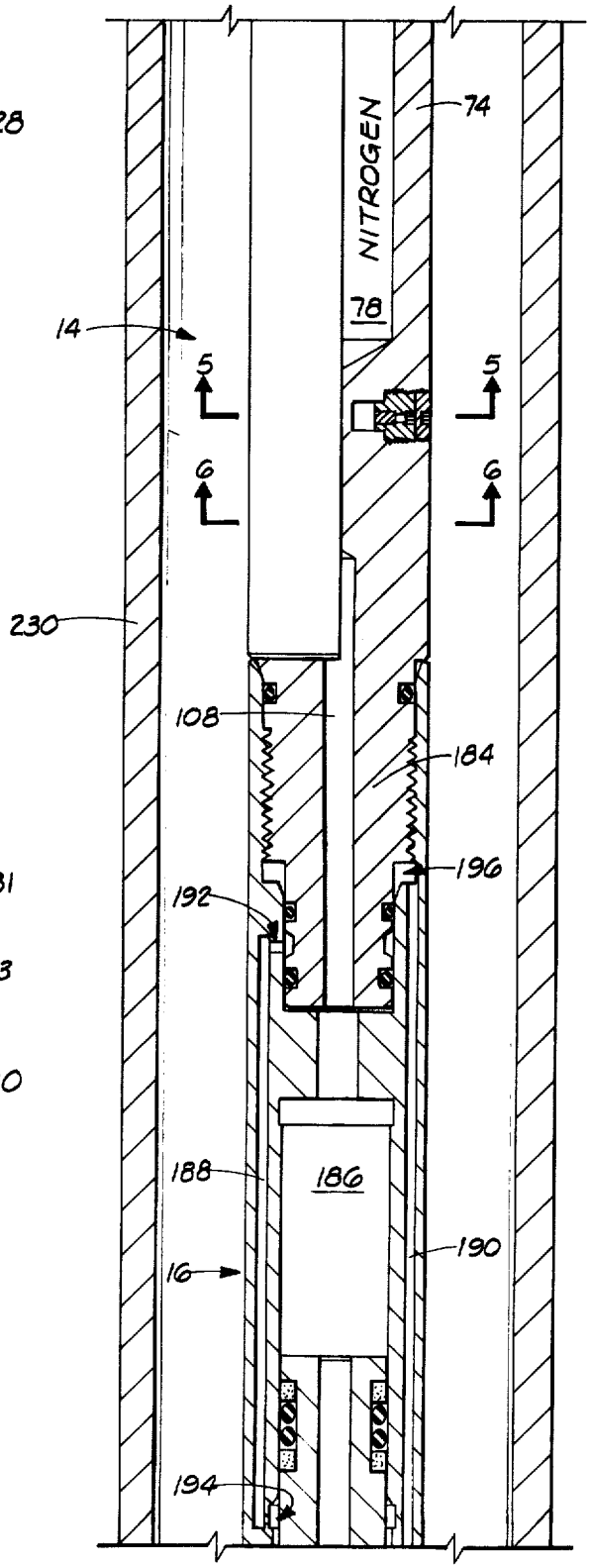
Figure 1G:
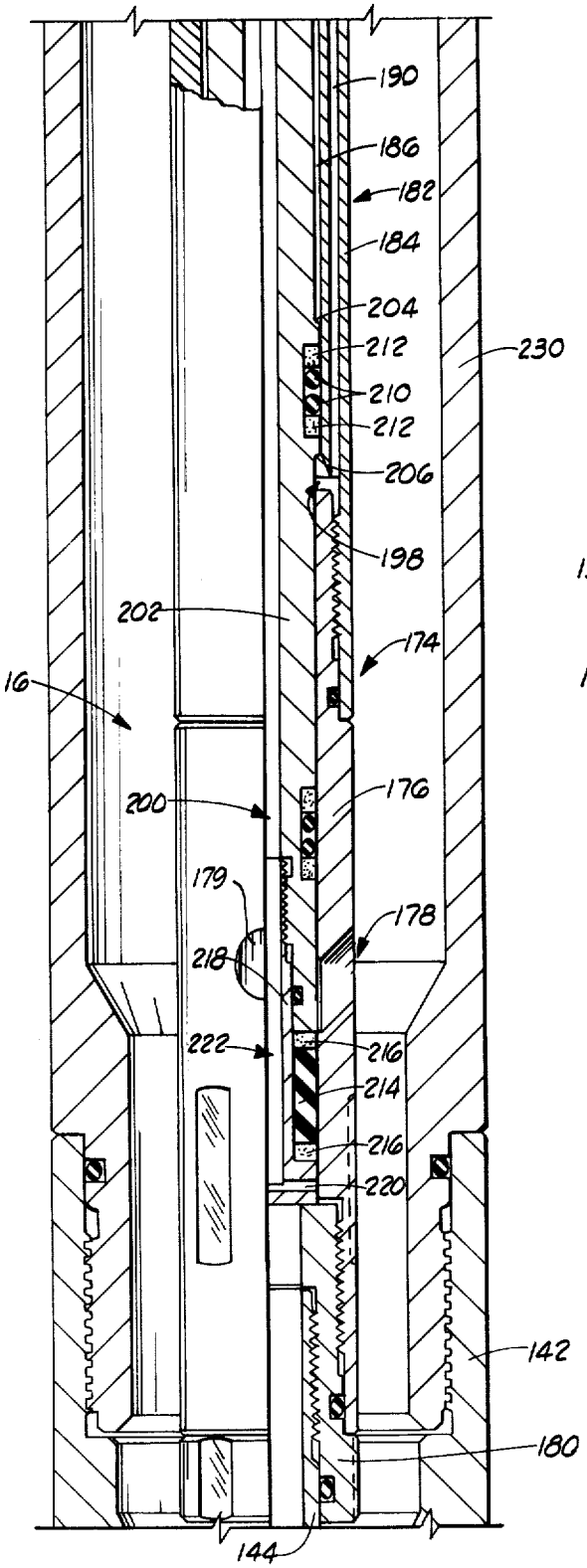
Figure 1H:
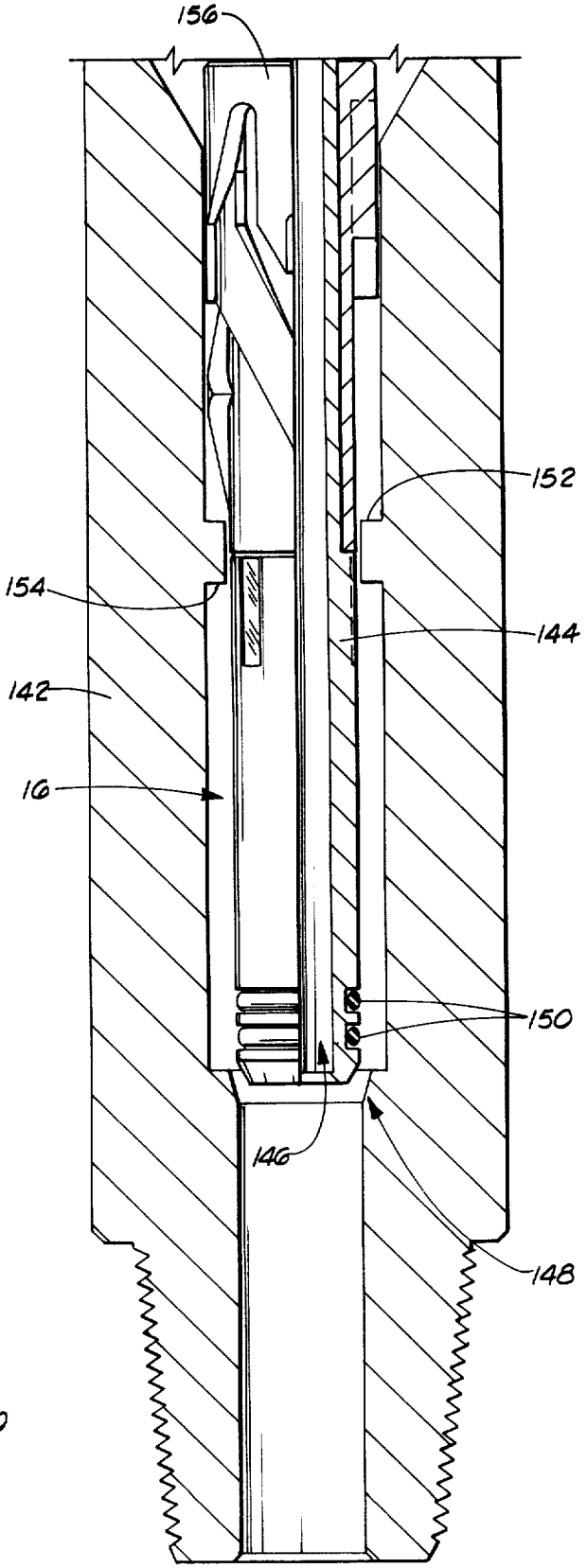

The tester section 16 includes a housing structural means having a first end, a second end engageable with a landing element 142 shown in FIG. 9, an exterior surface extending between the first and second ends, and an interior surface extending between the first and second ends and defining a hollow region between the first and second ends. The structural means also has an opening defined therein between the interior surface and the exterior surface. The preferred embodiment of this structure is shown in FIGS. 1F–1H.

The drawings depicting the preferred embodiment show the structural means includes a sealing mandrel 144 having an opening 146 extending longitudinally therethrough. The sealing mandrel 144 has the second end of the structural means as indicated by the reference numeral 148. The second end 148 is beveled and has O-rings 150 for fluid-tightly sealing the sealing mandrel 144 when it is engaged with the landing element 142 illustrated as a landing nipple in FIG. 1H. The landing nipple 142 is shown in FIG. 1H to include lugs such as are identified by reference numerals 152 and 154.

Associated with the sealing mandrel 144 is a locking element specifically shown as a J-slot element 156 for retaining the well unit 4 at its proper downhole position. The J-slot element 156 is rotatably mounted on the sealing mandrel 144 so that the J-slot 156 is free to rotate upon engagement with the lugs 152 and 154 or other lugs located in the landing nipple 142 as the well unit tool 4 of the present invention is lowered into the well 6 and seated in the landing nipple 150. Upon suitable engagement as subsequently described, the J-slot 156 locks into place to prevent pressure from below the second end 148 forcing the tool out of the landing nipple.

Figure 8:
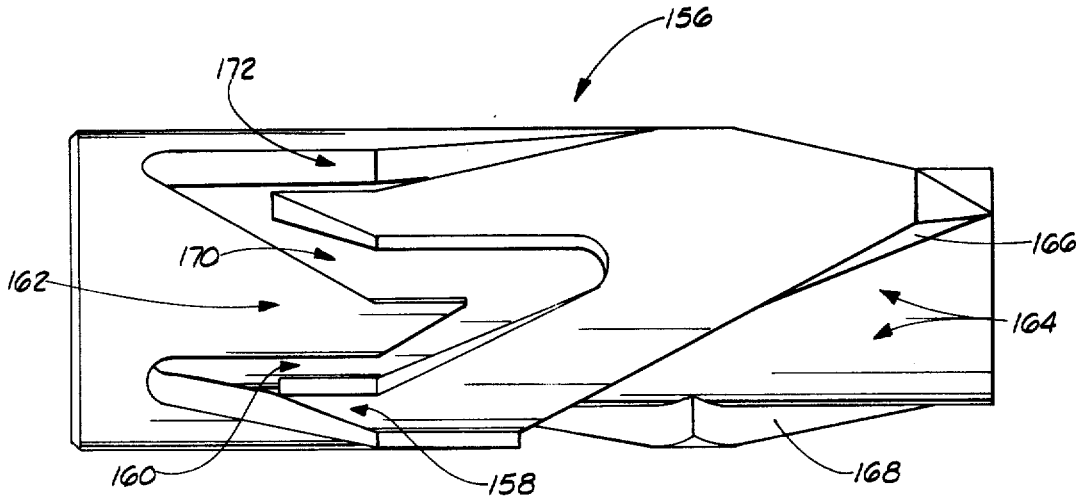
FIG. 8 is a side view of a J-slot element.

The J-slot element 156 is more particularly shown in FIG. 8. The J-slot 156 includes securing means for securing the well unit 4 in the well 6 in response to a first single downward movement and a first single upward movement of the securing means adjacent the landing element 142. The securing means is shown in FIG. 8 to include a first leg 158 and a second leg 160 of a substantially four-legged sinuous groove 162 defined in the member 156. To guide the lugs on the landing nipple into the first leg 156, the J-slot 156 includes guide means 164 comprising a first wall 166 and a second wall 168. The walls 166 and 168 are formed so that regardless which wall is engaged by the lug in the landing nipple, the lug is directed into the groove of the first leg 158. Specifically, the wall 166 adjoins a wall forming the leg 158, and the wall 168 includes a protruding portion for directing a lug engaging the wall 168 into the first leg 158.

The J-slot 156 also includes releasing means for releasing the wall unit 4 from securement in the well in response to a second single downward movement and a second single upward movement of the releasing means adjacent the landing element 142. The releasing means is particularly illustrated in FIG. 8 to include a third leg 170 and a fourth leg 172 of the sinuous groove 162. The fourth leg 172 exits into a guide element similar to the guide means 164 but circumferentially spaced around the member 156 therefrom. In addition to having a similar guide spaced from the guide 164, the member 156 includes a second sinuous groove similar to the groove 162 but spaced therefrom around the circumference of the member 156.

The structural means of the tester section 16 also includes a lower tester housing 174 having a wall 176 with an interior surface defining a passageway. The wall 176 also has defined therethrough the aforementioned opening which extends between the interior and exterior surfaces of the tester section structural means. This opening is identified in FIG. 1G by the reference numeral 178. The preferred embodiment includes four such openings spaced approximately 90° apart; a part of a second one of the openings is identified in FIG. 1G by the reference numeral 179. The sealing mandrel 144 and the lower housing 174 are connected by suitable connecting means 180 so that the opening 146 in the sealing mandrel 144 is in fluid communication with the passageway in the lower housing 174.

The structural means of the tester section 16 also includes an upper tester housing 182 which is threadedly connected to the lower tester housing 174. The upper tester housing 182 includes a wall 184 defining a cavity 186 which communicates with a first channel 188 and a second channel 190 defined in the wall 184.

The first channel 188 provides a first tester channel which communicates with the first accumulator channel 84. This communication occurs through a port 192, shown in FIG. 1F disposed in the interior surface of the upper tester housing 182, interfacing with the port 88. The channel 188 has a second end associated with a port 194 which communicates with the cavity 186.

The channel 190 provides a second tester channel which communicates with the second accumulator channel 90 by means of a port 196 disposed in the interior surface of the upper tester housing 182 so that the port 196 communicates with the port 94 of the second accumulator channel 90. The channel 190 has a second port 198 associated therewith for communicating the channel 190 with the cavity 186 of the upper housing 182.

The cavity 186 of the upper tester housing 182 also communicates with the test pressure channel 102 of the accumulator section 14.

The tester section 16 also includes valve means for permitting fluid in the well entering the well unit 4 through the opening 146 to flow from a central void region provided by the passageway in the lower housing 174 to the exterior surface of the tool through the opening 178 or for preventing the fluid from flowing from the central void region to the exterior surface of the tool through the opening 178. The valve means is identified in FIG. 1G by the reference numeral 200 and is moved along the interior surface of the tester housing adjacent the opening 178 in response to hydraulic control pressure provided by the valve drive means disposed in the accumulator section 14 in response to control signals from the control section 10. When no control signals are received by the valve drive means, the valve drive means positions the valve means 200 to prevent the fluid from flowing through the opening 178 to the exterior surface of the tool. The position of the valve means 200 shown in FIG. 1G is a closed position wherein the fluid in the well is prevented from flowing from the opening 146 to the opening 178. In response to hydraulic pressure from the accumulator section 14, the valve means 200 can be moved upward as viewed in FIG. 1G to an open position wherein the fluid in the well is allowed to flow from the opening 146 to and through the opening 178 to the exterior of the well unit 4. Thus, the valve means opens or closes the passageway between the first opening 146 and the second opening 178.

The valve means 200 includes a hollow piston 202 specifically shown in FIG. 1G as a double-acting hydraulic cylinder which is slidably disposed in the passageway of the lower housing 174 and in the cavity of the upper housing 182 so that the hollow of the piston 202 is in pressure communication with the opening 146. The piston 202 includes a first surface 204 against which a fluid passing into the cavity 186 from the first tester channel 188 can act. The piston 202 includes a second surface 206 against which a fluid passing into the cavity 186 from the second tester channel 190 can act. When the fluid acts on the first surface 204, it tends to move the piston 202 in a first direction toward the closed position. When the fluid acts on the second surface 206, it tends to move the piston 202 in a second direction toward the open position. The surface 204 and the surface 206 are fluid-tightly separated from each other by suitable means, such as O-rings 210 and back-up elements 212.

Valve means 200 also includes sealing means associated with the piston 202 so that when the piston is in the first or closed position, the sealing means is disposed in the passageway to prevent fluid flow between the openings 146 and 178; and so that when the piston 202 is in the second or open position, the sealing means is disposed in the passageway to allow fluid flow between the openings 146 and 178. In the preferred embodiment the sealing means includes a resilient rubber seal member 214 bounded by two brass rings 216 which prevent extrusion of the seal 214.

The sealing means is connected to the piston 202 by suitable connector means. In the preferred embodiment the resilient seal member 214 is connected by means of a seal-retaining bolt or plug 218 which is threadedly connected to the end of the piston 202 disposed closer to the second end 148 of the structural means of the tester section 16. The bolt 218 has a pressure conducting path defined therein. The pressure conducting path includes a lateral channel 220 extending through the head of the bolt 218 and communicating with a longitudinal channel 222 extending longitudinally through the shaft and threaded end of the bolt 218. In the preferred embodiment there are a plurality of channels 220 spaced circumferentially around the head of the bolt 218.

The preferred embodiment of the valve means shown in FIG. 1G is constructed so that when the valve means 200 is in its closed position, the head of the bolt 218 is positioned adjacent the connector means 180 in such a manner that pressure entering from the well through the opening 146 passes around the head of the bolt 218 into the channel 220, the channel 222, and the hollow portion of the piston 202. This permits pressure from the well to be communicated to the cavity 186, the test pressure channel 102, the channel 58 and the cavity 50 for detection by the pressure sensing means 72 in the gauge section 12. This pressure communication occurs with the valve means 200 in either its closed position or its open position.

Having described the structure of the preferred embodiment of the present invention, its use with the well 6 will be described with reference initially to FIG. 9. In FIG. 9 the surface unit 2 is disposed outside the well, and the well unit 4 is disposed in the well 6. The well unit 4 is lowered into a position within a tubing string 224 which is set in the well 6 and in which is located the landing nipple 142. In the preferred embodiment the tubing 224 includes the structure identified in FIGS. 1A–1H. In particular, this structure includes an upper case 226, a lower case 228, a crossover case 230, a support 232 (having a wiper insert 234) retained between the lower case 228 and the crossover case 230, and the landing nipple 142. As shown in FIG. 9, associated with the tubing 224 is a testing packer 232 and a conventional tester valve 233 as known in the art. Although the preferred embodiment is shown in use with a conventional tester valve, it is contemplated that the present invention can be used without the conventional tester valve 234.

Connected to the control section of the well unit 4 is an actuator sub-assembly 236 of a type known in the art for latching the well unit tool in the tubing 224 and permitting upward and downward movement of the tool. A preferred embodiment of the actuator sub-assembly 236 includes an internally threaded top coupling connected to a housing which is connected to a latch case. Disposed within the latch case is a wiper insert. Also in the latch case is a latch retainer and latch. The sub-assembly 236 also includes a motor for moving the well unit 4 up and down.

It is to be noted that the well unit 4 can be positioned anywhere above the tester valve 234 by merely changing the location of the landing nipple 142. This permits the well unit 4 to be located at places where there is little or no debris buildup which can occur during flow of the well. Additionally, the well unit 4 can be located either above or below the surface of a water cushion as known in the art.

Prior to positioning the well unit 4 in the well 6, the tool is initialized. Initialization occurs by first pressurizing the accumulator section 14 through the introduction of nitrogen or other suitable pressurizing substance into the pressurizing fluid chamber 78 via the port shown in FIG. 6 having the assembly 120 associated therewith. This pressurization forces the floating accumulator piston 122 toward the separator element 116. Once pressurization of the chamber 78 is completed, the plug of the assembly 120 is replaced and hydraulic oil or other suitable substance is introduced into the driving fluid chamber 80 through the port with which the assembly 118 is associated as shown in FIG. 5. Introducing hydraulic oil into the chamber 80 forces the accumulator piston 122 to move away from the separator element 116. When the accumulator piston 122 has been properly positioned by these steps, the oil filling process is stopped and the plug of the assembly 118 is replaced. With the well unit 4 thus pressurized, it can be lowered into the tubing 224 in the well 6 as known in the art. The well unit 4 is electrically connected to the surface unit 2 by means of the wireline 8.

Prior to lowering the well unit 4 into the tubing 224, the packer 232 and the conditional tester valve 234 have been run into the hole while the tester valve 234 has been closed. As the well unit 4 is run into the hole of well 6, the valve means 200 is maintained in its open position. When the well unit 4 reaches the landing nipple 142, the motor in the actuator sub-assembly is actuated to continue lowering the well unit 4 so that the sealing mandrel 144 is inserted into the landing nipple 142. This downward movement causes a lug of the landing nipple to enter the first leg 158 of the J-slot 156 shown in FIG. 8 and to move therein until it engages stop means provided by the wall of the J-slot groove connecting the legs 158 and 160. The motor is then reversed and the well unit 4 is pulled up so that the lug enters the second leg 160 of the J-slot and moves therein until the lug engages another stop means provided by the wall of the J-slot groove connecting the legs 160 and 170. At this position the well unit 4 is in its locked position.

When the well unit 4 is in its locked position, the conventional tester valve 234 is opened and maintained open during the remainder of the drill stem test. With the conventional tester valve 234 open, the well unit 4 transmits electrical signals representing the well pressure to the surface unit 2 concomitantly with the sensing of the pressure. The initial pressure reading is the pressure during a flowing period because the valve means 200 is open as mentioned hereinabove. After a predetermined time period as known in the art, the valve means 200 is closed thereby closing in the well and permitting pressure in the well to build up and to be monitored and indicated at the surface. Such surface indication is again achieved concomitantly with the downhold sensing of the pressure. After another predetermined time period, the valve means 200 is again opened and closed one or two more times as is usual and known in the art for conducting drill stem tests. Temperature readings or other downhole condition readings can be obtained and concomitantly transferred to and displayed at the surface, too.

After a test has been conducted, the conventional tester valve 234 is closed. The motor in the actuator sub-assembly is operated to move the well unit 4 down so that the lug enters the third leg 170 of the J-slot groove, and then the motor is reversed to move the well unit 4 up whereby the lug enters the fourth leg 172 and exits the J-slot groove thereby unlocking the well unit 4 and permitting it to be retrieved from the well 6 as known in the art.

From this broad description of the operation of the present invention it is apparent that the tester section 16 operates to flow and close the well 6 during the drill stem test period. The accumulator section 14 operates to supply and switch hydraulic pressure to operate the valve means 200 of the tester section 16.

With reference to FIGS. 1D–1G and 7 the operation of the valve means 200 will be described. When no electrical signal is sent to the solenoid valve 132 from the control section 10 over the conductor 54, the poppet of the solenoid valve 132 is positioned so that the port 98 of the driving fluid channel 96 is connected to the port 86 of the first accumulator channel 84 to provide a path along which the pressurized hydraulic oil in the driving fluid chamber 80 is transferred through the ports 88 and 192 to the first channel 188 of the tester section 16 for acting against the first surface 204 of the piston 202. The poppet also is positioned to connect the port 92 of the second accumulator channel 90 with the accumulator chamber 82 so that fluid which may be forced out of the channel 190 of the tester section 16 is conducted through the ports 196 and 94 and the second accumulator channel 90 to the low pressure accumulator chamber 82. When the tool is serviced, the fluid is drained from the low pressure accumulator chamber 82 by removing the plug 110. These channel connections cause the valve means 200 to be moved to its closed position which is illustrated in FIG. 1G.

To move the valve means 200 to its open position, the solenoid valve 132 is energized by an electrical signal from the control section 10. This energization moves the poppet to connect the port 98 of the driving fluid channel 96 to the port 92 of the second accumulator channel 90 thereby providing a path through which the driving fluid can be conducted to the channel 190 of the tester section 16 for acting against the second surface 206 of the piston 202. This movement of the poppet of the solenoid valve 132 connects the port 86 of the first accumulator channel 84 with the accumulator chamber 82 thereby providing a path through which fluid forced through the channel 188 by the first surface 204 of the piston 202 can be vented.

From the foregoing it is apparent that the first accumulator channel 84 and the second accumulator channel 90 provide paths through which the driving fluid can be conducted either to the valve means or to the accumulator chamber. The driving fluid channel 96 provides a path through which the driving fluid can be switchably conducted to either the first accumulator channel or the second accumulator channel.

Passages through the tester section 16 and the accumulator section 14 permit formation pressure to be transmitted to the gauge section 12 for conversion into proportional electrical signals by means of the pressure sensing means 72 and for transmission of the signals to the surface unit 2 by means of the control section 10 and the electronic means disposed therein.

From the foregoing it is apparent that the well unit 4 broadly includes an elongated housing having an interior surface which defines a central void region extending longitudinally through the housing between a first end and a second end thereof. This housing has an exterior surface extending between the first and second ends and further has a communicating surface extending through the housing between the interior and exterior surfaces near the second end. This communicating surface has been disclosed herein to define the opening 178. Through this opening a fluid in the central void between the opening and the second end of the housing can be communicated to the exterior surface of the housing extending between the opening and the first end of the housing.

Disposed in this housing are first conduit means, second conduit means and third conduit means which are provided specifically in the preferred embodiment by the first and second accumulator channels, the first and second tester channels and the driving fluid channel. These channels are appropriately interconnected by the valve drive means to effect movement of the valve means disposed in the housing adjacent the opening.

In the preferred embodiment the housing comprising the various elements discussed hereinabove is preferably made of stainless steel or other suitable material capable of use in downhole environments. The housing is comprised of substantially cylindrical elements which are threadedly connected as illustrated in the figures and which are fluid-tightly sealed by suitable O-rings and backup elements as also illustrated in the accompanying drawings.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. An apparatus for sensing pressure in a well, comprising:

a housing including a driving fluid chamber, an accumulator chamber and having valve means disposed therein, a first opening defined therein for introducing a fluid from the well into the interior of said housing, a second opening defined therein for passing fluid from the interior to the exterior of said housing, and a passageway defined in the interior of said housing for connecting said first opening with said second opening, first conduit means communicating with a first portion of said valve means, second conduit means communicating with a second portion of said valve means;

valve drive means, disposed in said housing, for moving said valve means between a closed position wherein the fluid in the well is prevented from flowing from said first opening to said second opening and an open position wherein the fluid in the well is allowed to flow from said first opening to said second opening, said valve drive means including second valve means for switchably communicating either said third circuit means with said first conduit means and said second conduit means with said accumulator chamber or said third conduit means with said second conduit means and said first conduit means with said accumulator chamber so that said valve means is placed either in said closed position or said open position;

pressure sensing means, disposed in said housing, for sensing the pressure in the well both when said valve means is in its closed position and when said valve means is in its open position; and electronic means, disposed in said housing and responsive to said pressure sensing means, for communicating a signal corresponding to the magnitude of the sensed pressure to a location spaced from said housing.

2. An apparatus as defined in claim 1, further comprising second electronic means, disposed in said housing, for providing electrical control signals for controlling said valve drive means.

3. An apparatus as defined in claim 1, further comprising means for sensing temperature in the well and for communicating to a location spaced from said housing another signal representing the sensed temperature.

4. An apparatus as defined in claim 1, further comprising indicator means for receiving said signal from said electronic means and for providing a real-time indication of the sensed pressure.

5. An apparatus as defined in claim 1, further comprising indicator means for receiving said signal from said electronic means and for providing a real-time indication of the sensed pressure.

6. An apparatus as defined in claim 5, further comprising means for sensing temperature in the well and for communicating to a location spaced from said housing another signal representing the sensed temperature.

7. An apparatus as defined in claim 6, further comprising second electronic means, disposed in said housing, for providing electrical control signals for controlling said valve drive means.

8. An apparatus as defined in claim 1, further comprising means for sensing temperature in the well and for communicating to a location spaced from said housing another signal representing the sensed temperature.

9. An apparatus as defined in claim 8, further comprising second electronic means, disposed in said housing, for providing electrical control signals for controlling said valve drive means.

10. An apparatus as defined in claim 1, further comprising second electronic means, disposed in said housing, for providing electrical control signals for controlling said valve drive means.

11. An apparatus for sensing pressure in a well, comprising:

a housing having a first opening defined therein for introducing a fluid from the well into the interior of said housing, a second opening defined therein for passing fluid from the interior to the exterior of said housing, and a passageway defined in the interior of said housing for connecting said first opening with said second opening, said housing including:

a sealing mandrel having said first opening extending longitudinally therethrough;

a locking element associated with said sealing mandrel;

a lower housing having a first wall defining said passageway and having said second opening defined therethrough;

means for connecting said sealing mandrel with said lower housing so that said first opening is in fluid communication with said passageway; and an upper housing, connected to said lower housing, having a second wall defining a cavity, said second wall having a first channel and a second channel defined therein, each of said first and second channels communicating with said cavity; and valve means disposed in said housing including a hollow piston slidably disposed in said passageway and said cavity so that the hollow of said piston is in pressure communication with said first opening, said piston having a first surface against which a fluid passing into said cavity from said first channel can act and further having a second surface against which a fluid passing into said cavity from said second channel can act;

sealing means associated with said piston so that when said piston is in said closed position of said valve means, said sealing means is disposed in said passageway to prevent fluid flow between said first and second openings, and when said piston is in said open position of said valve means, said sealing means is disposed in said passageway to allow fluid flow between said first and second openings;

valve drive means disposed in said housing, for moving said valve means between a closed position wherein the fluid in the well is prevented from flowing from said first opening to said second opening and an open position wherein the fluid in the well is allowed to flow from said first opening to said second opening, said valve drive means including second valve means for switchably communicating either said third circuit means with said first conduit means and said second conduit means with said accumulator chamber or said third conduit means with said second conduit means and said first conduit means with said accumulator chamber so that said valve means is placed either in said closed position or said open position;

pressure sensing means, disposed in said housing, for sensing the pressure in the well both when said valve means is in its closed position and when said valve means is in its open position; and electronic means, disposed in said housing and responsive to said pressure sensing means, for communicating a signal corresponding to the magnitude of the sensed pressure to a location spaced from said housing.

12. An apparatus as defined in claim 11, wherein said locking element includes a J-slot member comprising:

securing means for securing said apparatus in the well in response to a first single downward movement and a first single upward movement; and releasing means for releasing said apparatus from securement in the well in response to a second single downward movement and a second single upward movement.

13. An apparatus as defined in claim 11, further comprising indicator means for receiving said signal from said electronic means and for providing a real-time indication of the sensed pressure.

14. An apparatus as defined in claim 13, further comprising means for sensing temperature in the well and for communicating to a location spaced from said housing another signal representing the sensed temperature.

15. An apparatus for sensing pressure in a well, comprising:

a housing having valve means disposed therein and having a first opening defined therein for introducing a fluid from the well into the interior of said housing, a second opening defined therein for passing fluid from the interior to the exterior of said housing, and a passageway defined in the interior of said housing for connecting said first opening with said second opening;

said housing including a well with an interior surface defining side boundaries of a pressurizing fluid chamber for receiving a pressurizing fluid, of a driving fluid chamber for receiving a driving fluid, and of an accumulator chamber, said wall including:

a first accumulator channel defined therein for switchably communicating the driving fluid either from said driving fluid chamber to said valve means or from said valve means to said accumulator chamber;

a second accumulator channel defined therein for switchably communicating the driving fluid from said valve means to said accumulator chamber when said first accumulator channel communicates the driving fluid from said driving fluid chamber to said valve means or communicating the driving fluid from said driving fluid chamber to said valve means when said first accumulator channel communicates the driving fluid from said valve means to said accumulator chamber; and a driving fluid channel defined therein for communicating the driving fluid from said driving fluid chamber to either said first accumulator channel or said second accumulator channel;

valve drive means, disposed in said housing, for moving said valve means between a closed position wherein the fluid in the well is prevented from flowing from said first opening to said second opening and an open position wherein the fluid in the well is allowed to flow from said first opening to said second opening, said valve drive means including second valve means for switchably communicating either said third circuit means with said first conduit means and said second conduit means with said accumulator chamber or said third conduit means with said second conduit means and said first conduit means with said accumulator chamber so that said valve means is placed either in said closed position or said open position, said valve drive means including an accumulator piston slidably disposed between said pressurizing fluid chamber and said driving fluid chamber, said accumulator piston being movable in response to pressure differentials between the fluid receivable by said pressuring fluid chamber and said driving fluid chamber;

accumulator valve means for switchably connecting said high pressure channel with either said first accumulator channel to said second accumulator channel;

pressure sensing means, disposed in said housing, for sensing the pressure in the well both when said valve means is in its closed position and when said valve means is in its open position; and electronic means, disposed in said housing and responsive to said pressure sensing means, for communicating a signal corresponding to the magnitude of the sensed pressure to a location spaced from said housing.

16. An apparatus as defined in claim 15, wherein said wall further includes a test pressure channel defined therein for communicating well pressure from said passageway to said pressure sensing means.

17. An apparatus as defined in claim 16, further comprising indicator means for receiving said signal from said electronic means and for providing a real-time indication of the sensed pressure.

18. An apparatus for sensing pressure in a well, comprising:

a housing having valve means disposed therein and including a first opening defined therein for introducing a fluid from the well into the interior of said housing, a second opening defined therein for passing fluid from the interior to the exterior of said housing, and a passageway defined in the interior of said housing for connecting said first opening with said second opening;

valve drive means, disposed in said housing, for moving said valve means between a closed position wherein the fluid in the well is prevented from flowing from said first opening to said second opening and an open position wherein the fluid in the well is allowed to flow from said first opening to said second opening;

pressure sensing means, disposed in said housing, for sensing the pressure in the well both when said valve means is in its closed position and when said valve means is in its open position;

electronic means, disposed in said housing and responsive to said pressure sensing means, for communicating a signal corresponding to the magnitude of the sensed pressure to a location spaced from said housing;

said housing further including a tester housing having said first opening, said second opening, and said passageway defined therein;

an accumulator housing, connected to said tester housing, having said valve drive means disposed therein;

a gauge housing, connected to said accumulator housing, having said pressure sensing means disposed therein;

a control housing, connected to said gauge housing, having said electronic means disposed therein; and wherein said tester housing includes:

a sealing mandrel having said first opening extending longitudinally therethrough;

a locking element associated with said sealing mandrel;

a lower housing having a first wall defining said passageway and having said second opening defined therethrough;

means for connecting said sealing mandrel with said lower housing so that said first opening is in fluid communication with said passageway; and an upper housing, connected to said lower housing, having a second wall defining cavity, said second wall having a first channel and a second channel defined therein, each of said first and second channels communicating with said cavity; and wherein said valve means includes:

a hollow piston slidably disposed in said passageway and said cavity so that the hollow of said piston is in pressure communication with said first opening, said piston having a first surface against which a fluid passing into said cavity from said first channel can act and further having a second surface against which a fluid passing into said cavity from said second channel can act; and further including sealing means associated with said piston so that when said piston is in said closed position of said valve means, said sealing means is disposed in said passageway to prevent fluid flow between said first and second openings; and when said piston is in said open position of said valve means, said sealing means is disposed in said passageway to allow fluid flow between said first and second openings.

19. An apparatus as defined in claim 18, wherein said locking element includes a J-slot member comprising:

securing means for securing said apparatus in the well in response to a first single downward movement and a first single upward movement; and releasing means for releasing said apparatus from securement in the well in response to a second single downward movement and a second single upward movement.

20. An apparatus as defined in claim 18, wherein:

said accumulator housing includes a wall with an interior surface defining side boundaries of a pressurizing fluid chamber for receiving a pressurizing fluid, of a driving fluid chamber for receiving a driving fluid, and of an accumulator chamber, said wall including:

a first accumulator channel defined therein for switchably communicating the driving fluid either from said driving fluid chamber to said first channel of said upper housing or from said first channel of said upper housing to said accumulator chamber;

a second accumulator channel defined therein for switchably communicating the driving fluid from said second channel of said upper housing to said accumulator chamber when said first accumulator channel communicates the driving fluid from said driving fluid chamber to said first channel or communicating the driving fluid from said driving fluid chamber to said second channel of said upper housing when said first accumulator channel communicates the driving fluid from said first channel to said accumulator chamber; and a driving fluid channel defined therein for communicating the driving fluid from said driving fluid chamber to either said first accumulator channel or said second accumulator channel; and said valve drive means includes:

an accumulator piston slidably disposed between said pressurizing fluid chamber and said driving fluid chamber, said accumulator piston being movable in response to pressure differentials between the fluids receivable by said pressurizing fluid chamber and said driving fluid chamber; and accumulator valve means for switchably connecting said driving fluid channel with either said first accumulator channel or said second accumulator channel.

21. An apparatus as defined in claim 20, wherein said locking element includes a J-slot member comprising:

securing means for securing said apparatus in the well in response to a first single downward movement and a first single upward movement; and releasing means for releasing said apparatus from securement in the well in response to a second single downward movement and a second single upward movement.

22. An apparatus as defined in claim 20, wherein said wall further includes a test pressure channel defined therein for communicating well pressure from said tester housing to said gauge housing.

23. An apparatus as defined in claim 22, wherein said locking element includes a J-slot member comprising:

securing means for securing said apparatus in the well in response to a first single downward movement and a first single upward movement; and releasing means for releasing said apparatus from securement in the well in response to a second single downward movement and a second single upward movement.

24. An apparatus as defined in claim 22, further comprising indicator means for receiving said signal from said electronic means and for providing a real-time indication of the sensed pressure.

25. An apparatus as defined in claim 24, further comprising means for sensing temperature in the well and for communicating to a location spaced from said housing another signal representing the sensed temperature.

26. A wireline tool for sensing pressure in a well, the well having a tubing disposed therein and the tubing having a landing element located therein, said tool comprising:

a tester section including:

first structural means having a first end, a second end engageable with the landing element, an exterior surface extending between said first and second ends and an interior surface extending between said first and second ends and defining a hollow region between said first and second ends, said structural means also having an opening defined therein between said interior surface and said exterior surface;

retaining means, associated with said first structural means, for releasably retaining said second end in engagement with the landing element; and valve means for opening or closing said opening;

an accumulator section connected to said tester section, said accumulator section including:

a first wall defining a first cavity; and valve drive means, disposed in said first cavity, for actuating said valve means;

a gauge section connected to said accumulator section, said gauge section including:

a second wall defining a second cavity;

pressure sensing means, disposed in said second cavity, for sensing pressure in the well; and first electrical connector means, associated with said second wall, for receiving a first electrical signal and for conducting the first electrical signal to said valve drive means; and a control section connected to said gauge section, said control section including:

second structural means;

second electrical connector means, associated with said second structural means, for electrically contacting said first electrical connector means so that the first electrical signal is conducted through said first electrical connector means to said second electrical connector means;

first electrical circuit means, disposed in said control section, for transmitting to said first electrical connector means the first electrical signal; and second electrical circuit means, disposed in said control section, for receiving from said pressure sensing means a second electrical signal representing the sensed pressure.

27. An apparatus as defined in claim 26, wherein:

the landing element includes a lug; and said retaining means of said tester section includes a J-slot member, rotatably mounted on said first structural means, comprising:

securing means for engaging said J-slot member with said lug in response to a first single downward movement and a first single upward movement of said securing means adjacent said lug; and releasing means for disengaging said J-slot member from said lug in response to a second single downward movement and a second single upward movement of said releasing means adjacent said lug.

28. An apparatus as defined in claim 26, wherein:

said first electrical connector means includes:

a first resilient member, releasably disposed in said second wall, having an inner surface facing said second structural means of said control section; and first electrical conductor means disposed along said inner surface; and said second electrical connector means includes:

a second resilient member, releasably disposed in said second structural means, having an outer surface facing said second wall; and second electrical conductor means disposed along said outer surface in electrical contact with said first electrical conductor means.

29. An apparatus as defined in claim 26, wherein said valve means includes:

a hollow piston, slidably disposed in said hollow region, having a first surface against which a fluid can act to move said piston to a first position and further having a second surface against which a fluid can act to move said piston to a second position;

sealing means for closing said opening from said second end of said first structural means when said piston is moved to said first position and for opening said opening to said first end when said piston is moved to said second position; and connector means for connecting said sealing means to said piston.

30. An apparatus as defined in claim 29, wherein:

said sealing means includes a resilient member; and said connector means includes a seal-retaining bolt for fastening said resilient member to the end of said piston closer to said second end of said first structural means, said bolt having a pressure conducting path defined therein.

31. An apparatus as defined in claim 29, wherein:

said accumulator section further includes separator means disposed in said first cavity for defining an accumulator chamber therein;

said valve drive means includes an accumulator piston slidably disposed in said first cavity for defining a pressurizing fluid chamber and a driving fluid chamber therein; and said first wall includes:

a first accumulator channel defined therein for providing a path through which a driving fluid can be conducted either to said first surface of said valve means or to said accumulator chamber;

a second accumulator channel defined therein for providing a path through which a driving fluid can be conducted either to said accumulator means or to said second surface of said valve means;

a high pressure channel defined therein for providing a path through which a driving fluid can be switchably conducted to either said first accumulator channel or said second accumulator channel from said driving fluid chamber.

32. An apparatus as defined in claim 31, wherein:

said first wall further includes a test pressure channel defined therein;

said hollow region of said first structural means communicates with said test pressure channel; and said test pressure channel communicates with said second cavity of said second wall.

33. An apparatus as defined in claim 32, wherein:

the landing element includes a lug; and said retaining means of said tester section includes a J-slot member, rotatably mounted on said first structural means, comprising:

securing means for engaging said J-slot member with said lug in response to a first single downward movement and a first single upward movement of said securing means adjacent said lug; and releasing means for disengaging said J-slot member from said lug in response to a second single downward movement and a second single upward movement of said releasing means adjacent said lug.

34. An apparatus as defined in claim 32, wherein:

said first electrical connector means includes:

a first resilient member, releasably disposed in said second wall, having an inner surface facing said second structural means of said control section; and first electrical conductor means disposed along said inner surface; and said second electrical connector means includes:

a second resilient member, releasably disposed in said second structural means, having an outer surface facing said second wall; and second electrical conductor means disposed along said outer surface in electrical contact with said first electrical conductor means.

35. An apparatus as defined in claim 32, wherein:

said sealing means includes a resilient member; and said connector means includes a seal-retaining bolt for fastening said resilient member to the end of said piston closer to said second end of said first structural means, said bolt having a pressure conducting path defined therein communicating with said hollow region of said first structural means.

36. An apparatus as defined in claim 32, wherein said valve drive means further includes solenoid valve means, responsive to the first electrical signal, for switchably connecting said high pressure channel to either said first accumulator channel or said second accumulator channel.

37. An apparatus as defined in claim 26, wherein:

said accumulator section further includes separator means disposed in said first cavity for defining an accumulator chamber therein;

said valve drive means includes an accumulator piston slidably disposed in said first cavity for defining a pressurizing fluid chamber and a driving fluid chamber therein; and said first wall includes:

a first accumulator channel defined therein for providing a path through which a driving fluid can be conducted either to said valve means or to said accumulator chamber;

a second accumulator channel defined therein for providing a path through which a driving fluid can be conducted either to said accumulator means or to said valve means; and a high pressure channel defined therein for providing a path through which a driving fluid can be switchably conducted to either said first accumulator channel or said second accumulator channel from said driving fluid chamber.

38. An apparatus as defined in claim 37, wherein said first wall further includes a test pressure channel defined therein for communicating well pressure from said tester section to said gauge section.

39. An apparatus as defined in claim 37, wherein said valve drive means further includes solenoid valve means, responsive to the first electrical signal, for switchably connecting said high pressure channel to either said first accumulator channel or said second accumulator channel.

40. An apparatus as defined in claim 37, wherein:

said valve means includes a piston, slidably disposed in said hollow region, having a first surface against which a driving fluid can act to move said piston in a first direction and further having a second surface against which a fluid can act to move said piston in a second direction;

said first structural means includes:

a first tester channel communicating with said first accumulator channel and said first surface of said piston; and a second tester channel communicating with said second accumulator channel and said second surface of said piston.

41. An apparatus as defined in claim 26, wherein:

said first wall includes a test pressure channel defined therein;

said hollow region of said first structural means communicates with said test pressure channel; and said test pressure channel communicates with said second cavity of said second wall.

* * * * *